US006623829B1

(12) United States Patent
Fuss et al.

(10) Patent No.: US 6,623,829 B1
(45) Date of Patent: Sep. 23, 2003

(54) TEAR-OFF CUSHIONS OF LOOSE FILL PACKING MATERIAL

(75) Inventors: Gunter G. Fuss, San Mateo, CA (US); Vladimir Yampolsky, San Carlos, CA (US)

(73) Assignee: Free-Flow Packaging International, Inc., Redwood City, CA (US)

( * ) Notice: Subject to any disclaimer, the term of this patent is extended or adjusted under 35 U.S.C. 154(b) by 0 days.

(21) Appl. No.: 09/560,420

(22) Filed: Apr. 27, 2000

Related U.S. Application Data

(62) Division of application No. 09/288,775, filed on Apr. 8, 1999, now Pat. No. 6,560,948.

(51) Int. Cl.[7] ..... B32B 9/00

(52) U.S. Cl. ..... 428/71; 428/43; 428/72; 428/74; 428/76; 428/178

(58) Field of Search ..... 428/43, 74, 72, 428/76, 178, 71

(56) References Cited

U.S. PATENT DOCUMENTS

| | | | | | |
|---|---|---|---|---|---|
| 1,521,725 | A | | 1/1925 | Stanley | 53/136.3 |
| 2,656,658 | A | | 10/1953 | Grady | 53/576 |
| 3,210,908 | A | | 10/1965 | Samberg | 53/546 |
| 3,553,924 | A | | 1/1971 | Bonami | 53/417 |
| 3,667,593 | A | | 6/1972 | Pendleton | 206/584 |
| 3,688,650 | A | * | 9/1972 | de Vries | 493/200 |
| 3,938,300 | A | | 2/1976 | Lovqvist | 53/516 |
| 4,579,756 | A | * | 4/1986 | Edgel | 428/34 |
| 4,750,846 | A | * | 6/1988 | Myklebust et al. | 383/8 |
| 4,790,124 | A | | 12/1988 | Kaji | 53/552 |
| 4,844,291 | A | | 7/1989 | Fuss | 222/470 |
| 4,938,007 | A | | 7/1990 | Sperry | 53/449 |
| 4,996,819 | A | | 3/1991 | Davis | 53/64 |
| 5,032,439 | A | * | 7/1991 | Glicksman et al. | 428/44 |
| 5,340,632 | A | * | 8/1994 | Chappuis | 428/71 |
| 5,641,368 | A | * | 6/1997 | Romes et al. | 156/71 |
| 5,667,863 | A | * | 9/1997 | Cullen et al. | 428/68 |
| 5,673,534 | A | | 10/1997 | Fowler | 53/133.4 |
| 5,693,163 | A | | 12/1997 | Hoover et al. | 156/147 |
| 5,778,642 | A | | 7/1998 | Fuss et al. | 53/567 |
| 5,782,061 | A | | 7/1998 | Clazie et al. | 53/451 |
| 5,782,067 | A | | 7/1998 | Fuss et al. | 53/576 |
| 5,826,404 | A | | 10/1998 | Fuss et al. | 53/459 |
| 5,899,049 | A | | 5/1999 | Fuss et al. | 53/459 |

FOREIGN PATENT DOCUMENTS

| | | | | | |
|---|---|---|---|---|---|
| GB | 1402962 | A | * | 8/1975 | B65D/33/08 |
| GB | 2186864 | A | * | 8/1987 | B65D/81/12 |

* cited by examiner

*Primary Examiner*—Michael Barr
*Assistant Examiner*—Elena Tsoy
(74) *Attorney, Agent, or Firm*—Edward S. Wright

(57) ABSTRACT

String of packing cushions formed by two superposed layers of flexible plastic film sealed together along transversely extending lines to form a series of closed chambers, loose fill packing material in the chambers, and perforations in the film between the chambers defining tear lines by which the cushions can be separated. In certain disclosed embodiments, the string of cushions is made by positioning an elongated length of flexible plastic tubing about a chute, drawing a section of the tubing from the chute, introducing loose fill packing material through the chute into the section of the tubing which has been drawn from the chute, sealing the walls of the tubing together along a transversely extending seal line above the loose fill packing material to close the section and form a cushion, perforating the tubing along a transversely extending tear line above the cushion, and repeating the process to form successive cushions separated by tear lines.

6 Claims, 9 Drawing Sheets

TEAR-OFF CUSHIONS OF LOOSE FILL PACKING MATERIAL

This is a division of Ser. No. 09/288,775, filed Apr. 8, 1999, now U.S. Pat. No. 6,560,948.

This invention pertains generally to loose fill packing materials and, more particularly, to the packaging of loose fill packing materials in bags for use as cushions in shipping cartons and the like.

Loose fill packing materials are widely used in the protective packing of articles for shipment. They are commonly poured into a carton so as to surround and embrace the articles and thereby cushion them during shipment. Loose fill materials are fabricated of a variety of materials such as foamed plastics and, more recently, starch and other biodegradable materials.

One problem with loose fill materials is that they tend to spill both during packaging and also when the cartons are opened and the articles packed in them are removed. Being light in weight, the materials also have a tendency to fly about, and some of them exhibit a static cling which makes them particularly difficult to deal with.

U.S. Pat. Nos. 5,778,642, 5,782,061, 5,782,067 and 5,826,404 disclose manually operated machines for packaging loose fill packing materials in bags for use as cushions in shipping cartons. This solves the problems of spillage and static cling while retaining the advantages of loose fill materials. However, the cushions are formed individually, and the machines were intended for use at or near the locations where the cushions are used. That is a disadvantage for shippers who do not want to make their own cushions or to have the equipment for making the cushions in their facilities.

It is in general an object of the invention to provide a new and improved packing cushion and machine and method for making the same.

Another object of the invention is to provide a packing cushion, machine and method of the above character which eliminates the messiness, spillage and static cling which occur when articles are packed in loose fill materials.

These and other objects are achieved in accordance with the invention by providing a string of cushions formed by two superposed layers of flexible plastic film sealed together along transversely extending lines to form a series of closed chambers, loose fill packing material in the chambers, and perforations in the film between the chambers defining tear lines by -which the cushions can be separated. In certain disclosed embodiments, the string of cushions is made by positioning an elongated length of flexible plastic tubing about a chute, drawing a section of the tubing from the chute, introducing loose fill packing material through the chute into the section of the tubing which has been drawn from the chute, sealing the walls of the tubing together along a transversely extending seal line above the loose fill packing material to close the section and form a cushion, perforating the tubing along a transversely extending tear line above the cushion, and repeating the process to form successive cushions separated by tear lines.

Figure 1:
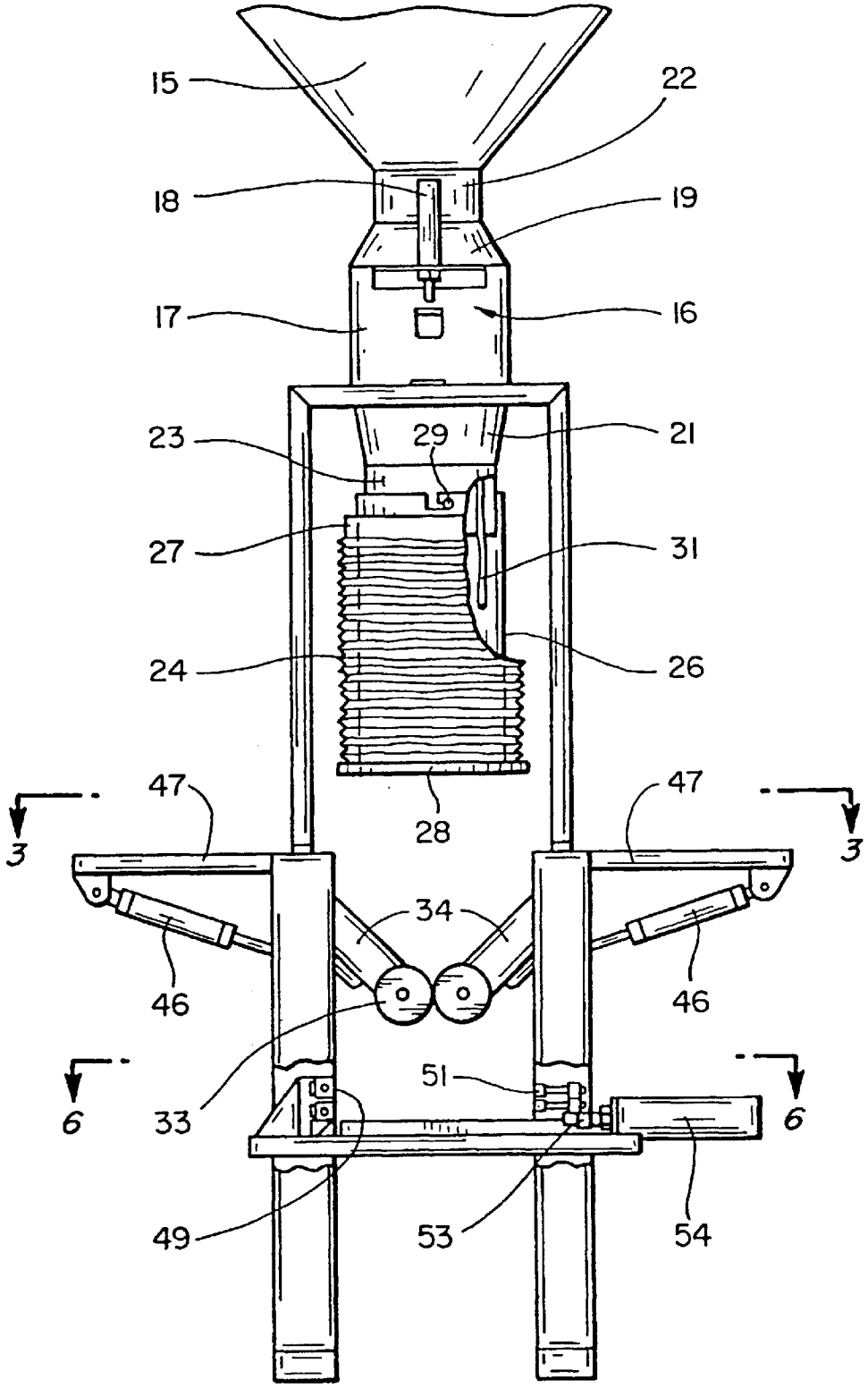
FIG. 1 is a front elevational view, partly broken away, of one embodiment of a machine for making packing cushions in accordance with the invention.

In FIG. 1, the machine is illustrated in conjunction with a hopper 15 which holds a supply of loose fill packing material. The hopper is mounted overhead, and the packing material is delivered to it from floor level by an air conveyor (not shown).

The machine includes an inlet valve 16 which is connected to the lower portion of the hopper for controlling the flow of material from the hopper. The valve can, for example, be of the type disclosed in U.S. Pat. No. 4,844,291, the disclosure of which is incorporated herein by reference. It has a generally rectangular body 17 with a pair of hinged flaps (not shown) connected to an operator 18 for controlling the flow of material through the valve. The valve has transition pieces 19, 21 on its inlet and outlet sides, with circular collars 22, 23 at the outer ends thereof.

A length of flexible tubing 24 is mounted on a tailpiece 26 on the outlet side of the valve for use in the cushions. The tubing is gathered axially and stored on a cylindrical core 27 which rests on a radial flange 28 at the lower end of the tailpiece. The tubing is withdrawn from the core by pulling it down over the flange, with the outer diameter of the flange being slightly larger than the unstretched tubing so that the tubing will not slide off the core unless it is pulled. The tailpiece is removably attached to outlet collar 23 by bayonet mounts 29.

In addition to supporting the supply of tubing, the tailpiece serves as a chute through which the loose fill is introduced into the tubing. A pair of air tubes 31 extend into the tailpiece on opposite sides of it and direct jets of air in a downward direction to facilitate movement of the relatively light packing material through the tailpiece.

The tubing can be fabricated of any suitable material such as polyethylene, and can be of any desired weight. In one presently preferred embodiment, the tubing material consists of a mixture of 60 percent low density polyethylene and 40 percent linear low density polyethylene. The tubing is perforated to prevent air from becoming entrapped in the cushions.

Means is provided for drawing successive sections of the tubing from the core into communication with the outlet of the valve. This means includes feed rollers 33 which are mounted on swing arms 34 for movement between an extended position in which the rollers engage the tubing and a retracted position in which the rollers are clear of the tubing. Each of the swing arms is mounted on an axle 36 which is pivotally mounted in bearing blocks 37 affixed to the frame of the machine. The feed rollers are mounted on a shaft 38 at the free end of the arm and driven by a gear motor 39 which is mounted on the arm. The driving connection is made by sprockets 41, 42 affixed to the motor and shaft and a drive belt or chain 43 trained about the sprockets. The shaft is rotatively mounted in bearings 44 on the swing arm.

Figure 2:
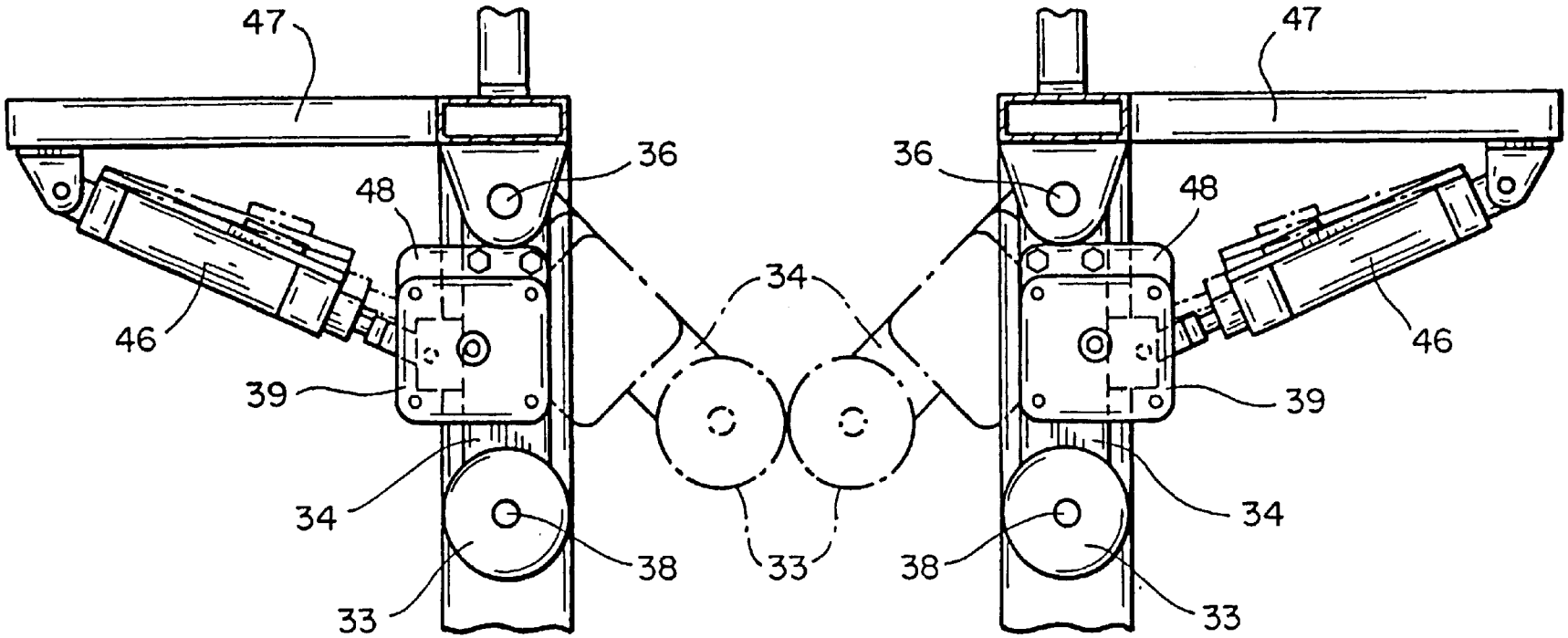
FIG. 2 is a fragmentary vertical sectional view of the embodiment of FIG. 1.
Figure 3:
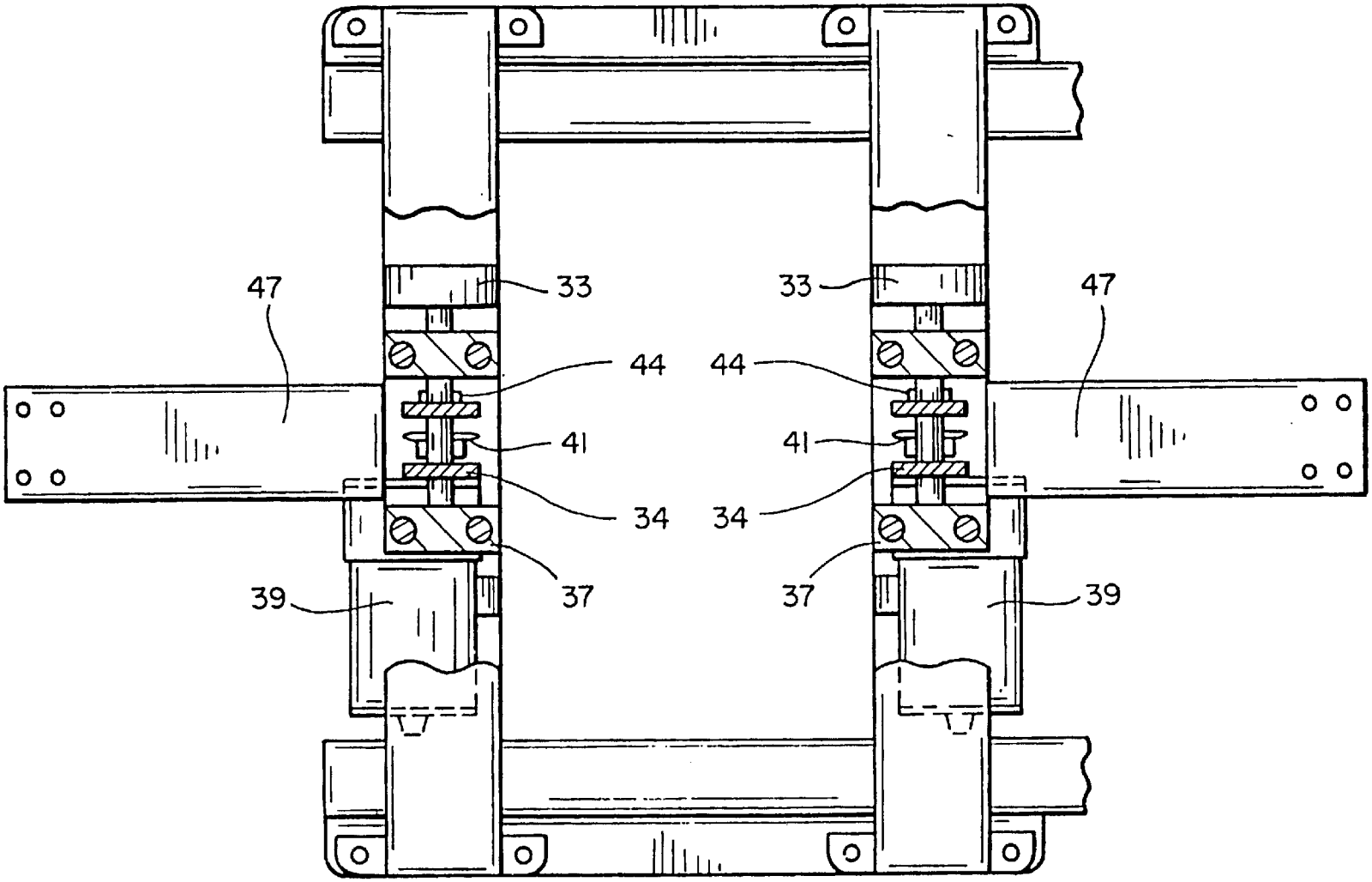
FIG. 3 is a horizontal sectional view taken along line 3—3 in FIG. 1.
Figure 4:
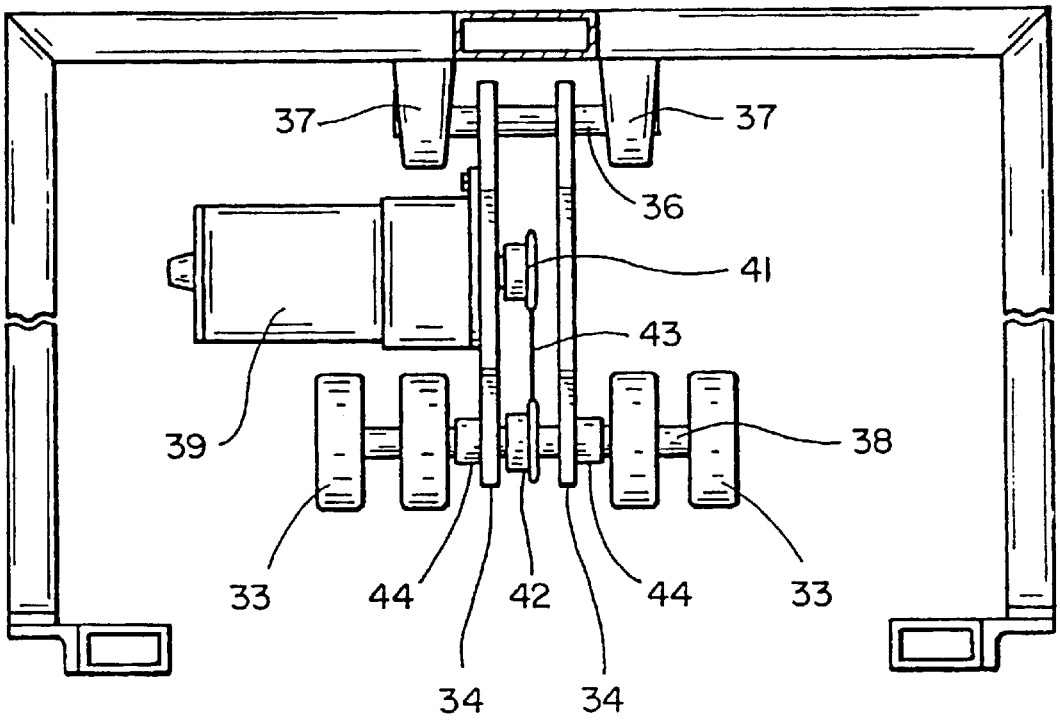
FIG. 4 is a fragmentary side elevational view of the embodiment of FIG. 1.
Figure 7:
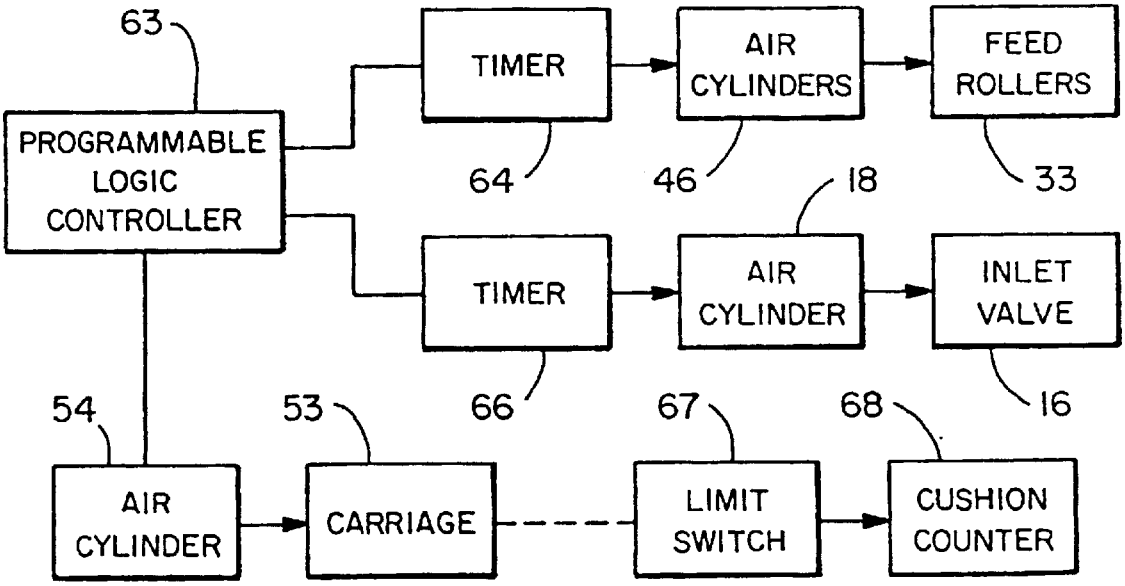
FIG. 7 is a simplified block diagram of the control system in the embodiment of FIG. 1.
Figure 5:
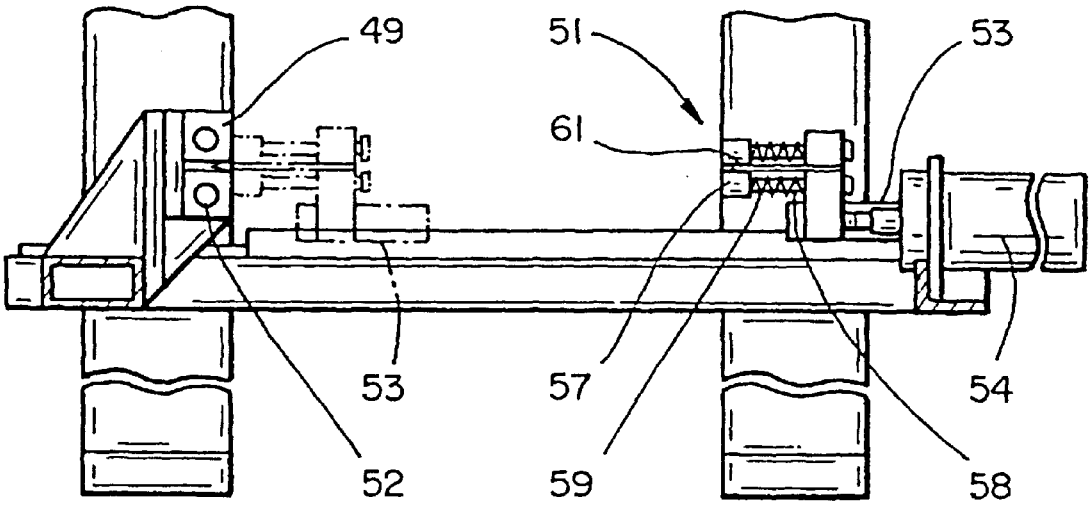
FIG. 5 is a fragmentary vertical sectional view of the embodiment of FIG. 1.
Figure 6:
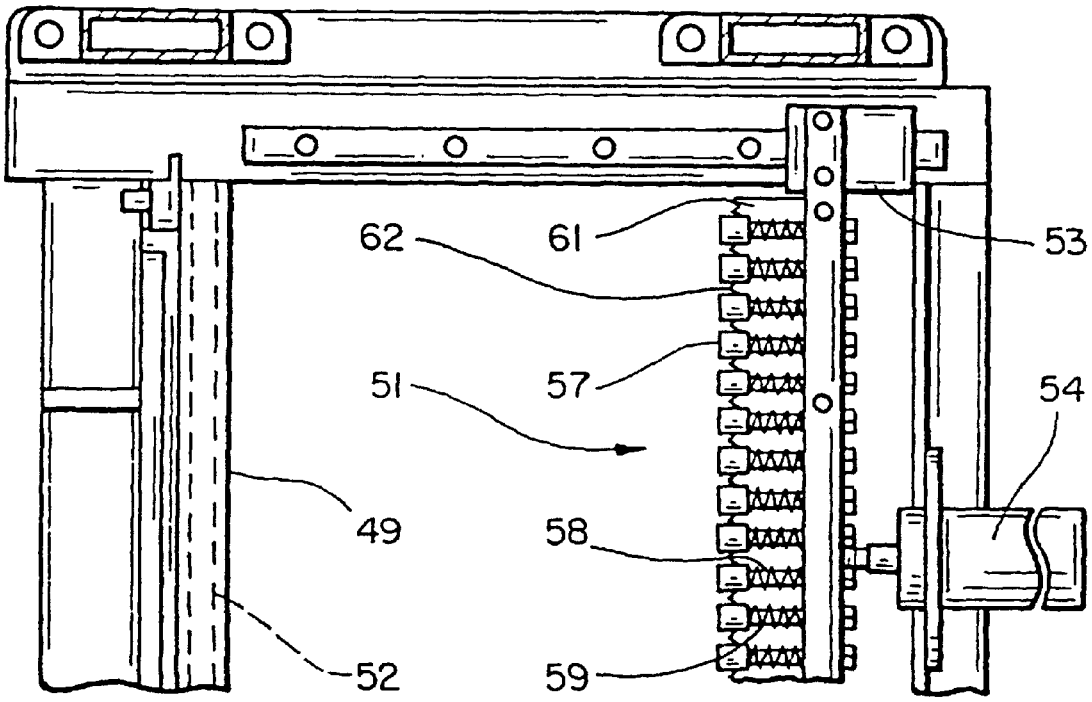
FIG. 6 is a fragmentary horizontal sectional view taken along line 6—6 in FIG. 1.

Air cylinders 46 are connected between arms 47 affixed to the frame and motor mounts 48 on the swing arms for moving the rollers between the extended and retracted positions. In the retracted position, which is shown in full lines in FIG. 2, the arms hang vertically beside the tubing and out of engagement with it. When the air cylinders are actuated, the arms swing inwardly and upwardly until the rollers carried by the two arms abut against each other, with the tubing between them. The spinning rollers then draw the tubing from the core and advance it in a downward direction.

Means is provided for sealing the tubing together along transversely extending lines to form bags into which the loose fill material is dispensed. This means includes a pair of horizontally extending sealing bars 49 and a plurality of plungers 51 for pressing the tubing against the sealing bars. The sealing bars are mounted in a fixed position on one side of the tubing, and are heated by internal elements 52. The plungers are mounted on a carriage 53 on the other side of the tubing and are arranged in two horizontally extending rows which are aligned with the sealing bars. The carriage is moved toward and away from the sealing bars by an air cylinder 54.

Each of the plungers has a ceramic tip 57 mounted on a shaft 58, with a coil spring 59 yieldably urging the plunger toward the sealing bar. The plungers produce individual, spot seals in the areas where they press the tubing against the sealing bars. With a separate spring for each plunger, the plungers act independently of each other, and if a piece of the packing material should become trapped between one of the plungers and a sealing bar, it will not affect the operation of the other plungers.

Means is also provided for perforating the tubing to form tear lines between the cushions. This means includes a knife 61 which is mounted in a fixed position on the carriage between the plungers. The knife has a plurality of triangular teeth 62 which face toward the sealing bars and pierce the tubing to form a row of perforations as the tubing is pressed against the sealing bars.

The machine is controlled by a programmable logic controller (PLC) 63. The PLC drives a timer 64 which determines how long air cylinders 46 are actuated to maintain the feed rollers in contact with the tubing, which determines the length of the cushions. The amount of loose fill material in each of the cushions is determined by another timer 66 which controls the length of time valve 16 is open. The PLC also controls the movement of carriage 53 and hence the operation of the sealer and perforator. A limit switch 67 activated by movement of carriage 53 is connected to a counter 68 to count the number of cushions which are made.

Operation and use of the machine, and therein the method of the invention, are as follows. The core of tubing is placed on the tailpiece, and the tailpiece is mounted on the valve. The lower portion of the tubing is pulled manually down over the ring on the tailpiece to a point below the sealing bars. When the machine is turned on, carriage 53 moves toward the sealing bars, and plungers 51 press the tubing against the sealing bars to seal the lower portion of the tubing.

Figure 8A:
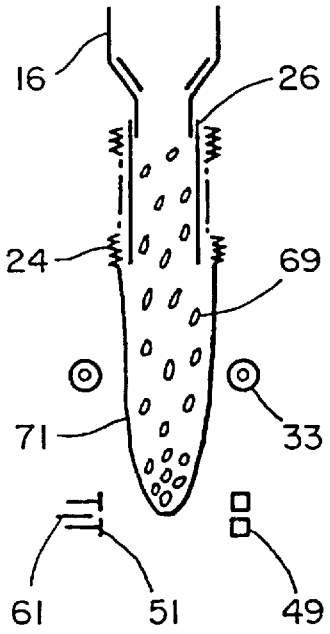
FIGS. 8A–8C are schematic views illustrating the operation of the embodiment of FIG. 1.
Figure 8B:
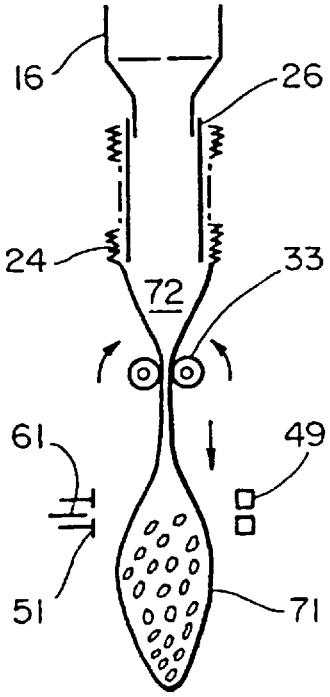

As illustrated in FIG. 8A, valve 16 is then opened for a predetermined period of time to deliver loose fill material 69 from the hopper to the section of tubing 71 above the seal. Thereafter, the feed rollers 33 are brought into engagement with the tubing, as shown in FIG. 8B, and the spinning rollers draw the next section of tubing 72 from the core. At the same time, the section 71 which has been filled advances down past the sealing bars. As noted above, the length of each cushion is determined by the amount of time the feed rollers remain in engagement with the tubing, and the amount of packing material in each cushion is determined by the length of time valve 16 remains open.

Figure 8C:
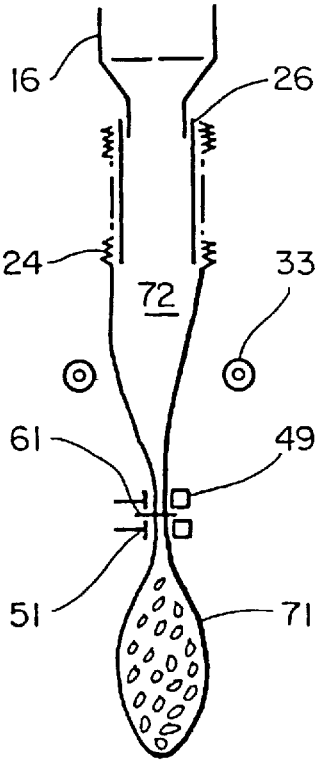

After the feed rollers have been retracted, carriage 53 is moved toward the sealing bars, as illustrated in FIG. 8C, and plungers 51 press the tubing against the bars to simultaneously seal the upper portion of section 71 and the lower portion of section 72. At the same time, knife teeth 62 pierce the tubing to form a row of perforations between the two seal lines.

Figure 9:
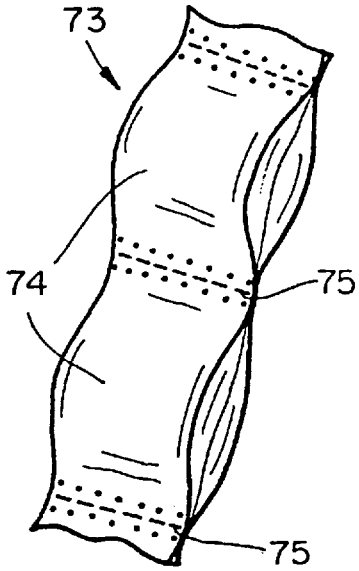
FIG. 9 is a fragmentary isometric view of a string of packing cushions made in accordance with the invention.

The carriage is then retracted, and the process is repeated to form a string of cushions 73 as illustrated in FIG. 9. This string comprises of a plurality of cushions 74 with tear lines 75 between them. Each cushion contains a predetermined amount of packing material, and the cushions can be tom apart and used individually or in groups, as desired.

Figure 10:
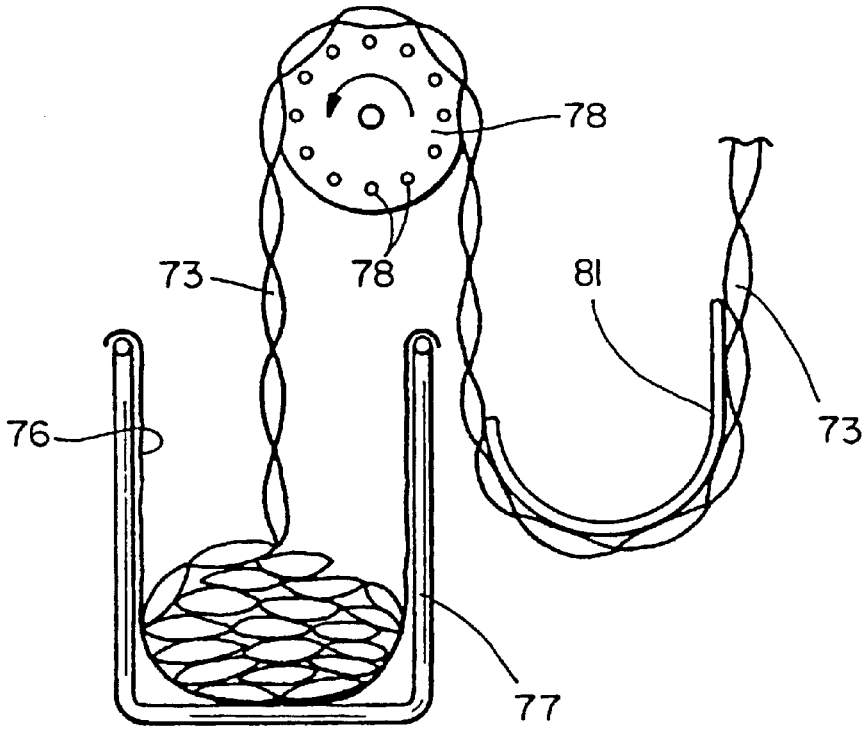
FIG. 10 is an elevational view, somewhat schematic, of a system for bagging the cushions made by the embodiment of FIG. 1.

FIG. 10 illustrates a system in which the strings of cushions made by the machine are packed into relatively large bags (e.g., 20 $ft^3$) for storage and shipment. In this system, a storage bag 76 is mounted on a framework 77, and the string of cushions 73 is fed from the machine to the bag by a drive wheel 78. The drive wheel has a plurality of pins 79 which project from its face by a distance slightly greater than the width of the cushions. The string of cushions emerging from the machine is trained about a J-shaped guide plate 81 at the base of the machine, then up around the pins of the drive wheel, and down into the storage bag. As the cushions emerge, the drive wheel delivers them to the bag. When the bag is full, it is removed from the framework and closed, and another bag is mounted on the framework in its place.

Figure 11:
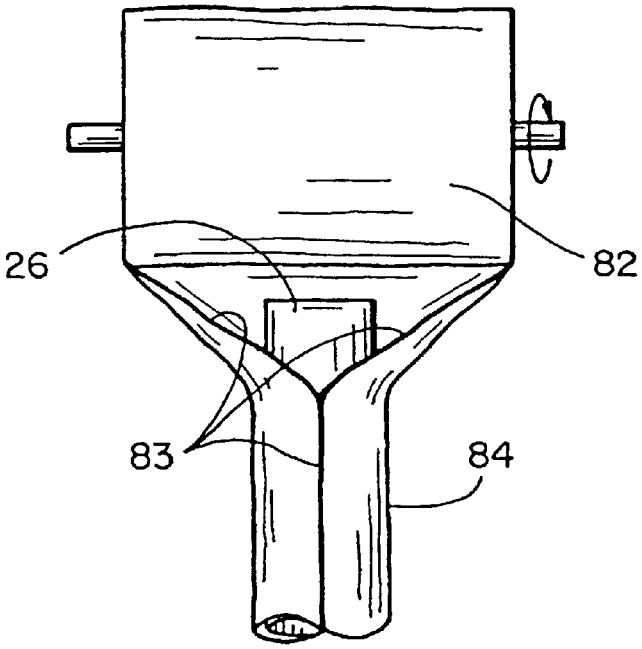
FIG. 11 is a fragmentary elevational view, somewhat schematic, of another embodiment of a machine for making packing cushions in accordance with the invention.

FIG. 11 illustrates an embodiment in which the tubing is made in running fashion, rather than being gathered and stored on a core in advance. In this embodiment, a roll of plastic film 82 is positioned near tailpiece 26, and as the film is drawn from the roll, it is wrapped around the tailpiece. The -edge portions 83 of the film are sealed together to form tubing 84 which is withdrawn from the lower end of the tailpiece and used in the same manner as tubing 24 in the embodiment of FIG. 1.

Figure 12:
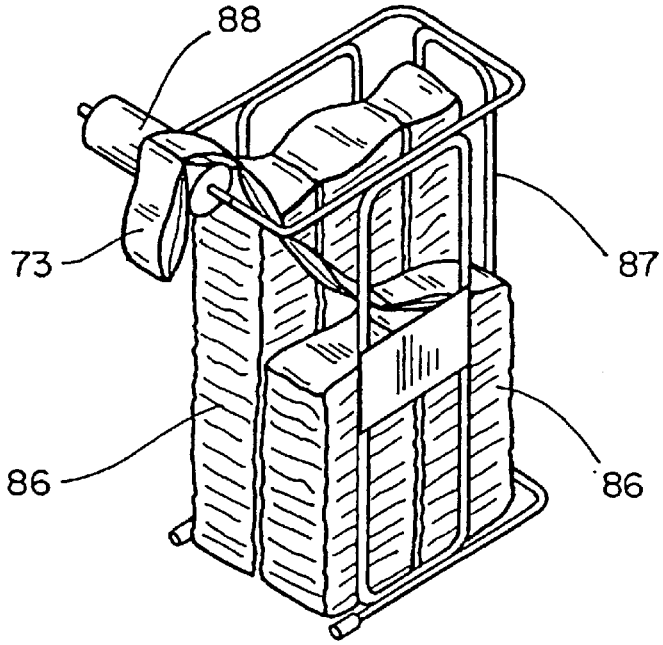
FIG. 12 is an isometric view of a dispenser with two bundles of packing cushions manufactured in accordance with the invention.

In the embodiment of FIG. 12, the strings of cushions 73 are layered in fanfold fashion to form two generally rectangular bundles 86 which are placed side-by-side in a dispenser 87. The dispenser includes a stationary support 88 over which the cushions are withdrawn.

Figure 14:
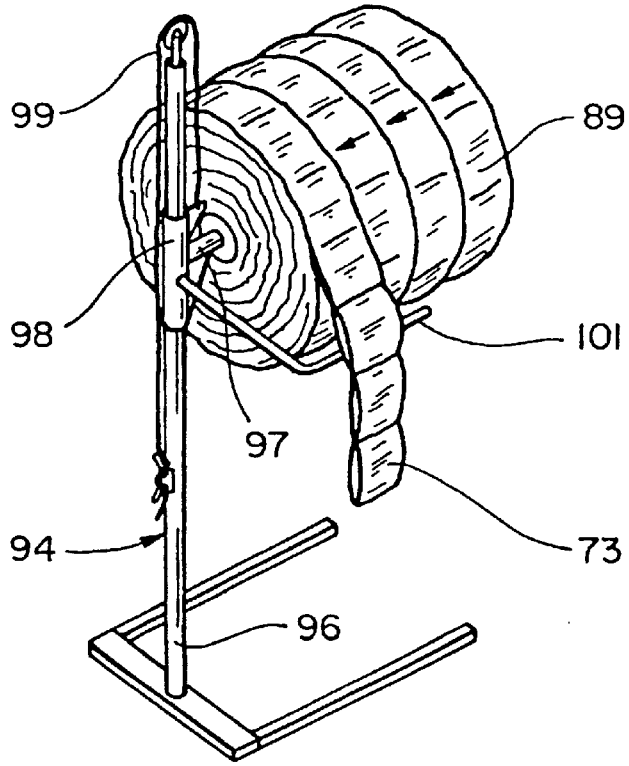
FIGS. 13 and 14 are isometric views of dispensers with rolls of packing cushions manufactured in accordance with the invention.
Figure 13:
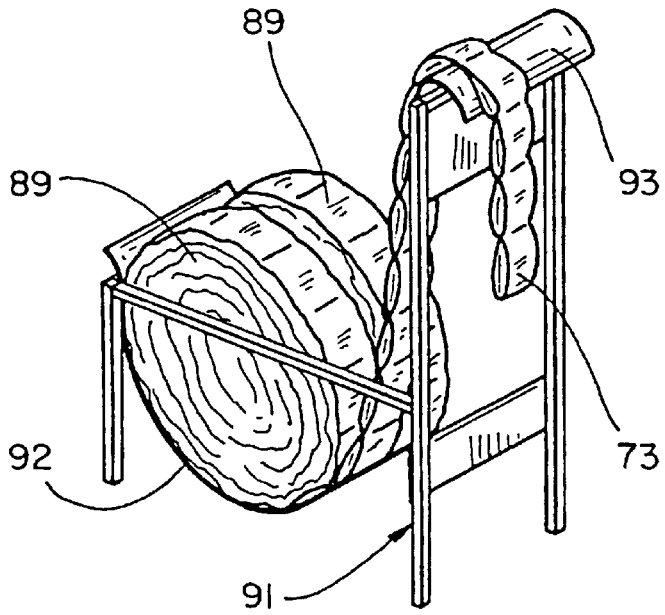

The strings of cushions 73 can also be formed into rolls 89 for storage and use, as illustrated in FIGS. 13 and 14. In the embodiment of FIG. 13, two rolls of the cushions are placed in a floor stand 91 which has a curved bottom wall 92 on which the rolls rest. The free ends of the rolls are trained up and over a curved surface 93 at the front of the dispenser.

In the embodiment of FIG. 14, four rolls of the cushions are mounted on a stand 94. This stand has an upright post 96 and a horizontally extending arm 97 on which the rolls are mounted. The arm is attached to a carriage 98 which is slidably mounted on the post for movement to different heights, with a cable or rope 99 for raising and lowering the arm. A support arm 101 extends in front of the roll closest to the post for holding the free end of the string away from the roll. In this particular embodiment, the cushions in the roll closest to the post are used first, and the remaining rolls are moved toward the post as they are needed.

Figure 15:
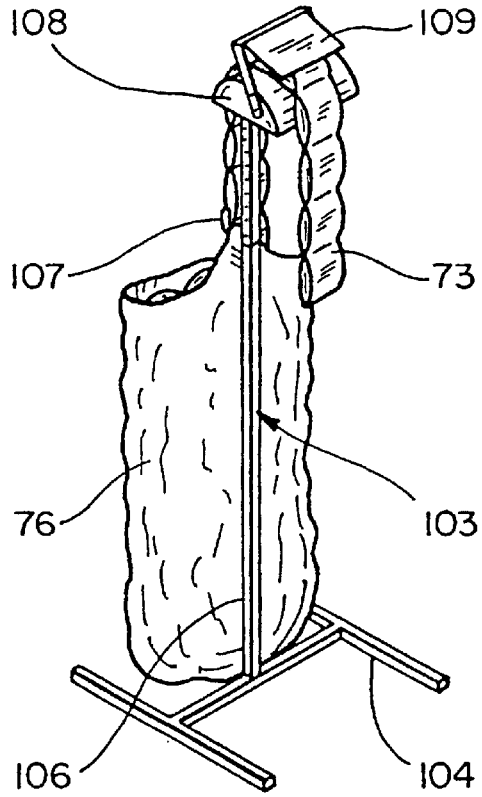
FIG. 15 is an isometric view of a dispenser with a bag of packing cushions manufactured in accordance with the invention.

FIG. 15 illustrates a dispenser for use with cushions packed in a bag 76 as in the embodiment of FIG. 10. The dispenser comprises a stand 103 which has base 104 and an upright 106 with a hook 107 on which the bag is hung. The string of cushions 73 is pulled from the bag and trained over a curved support 108 at the upper end of the upright, with the free end of the string hanging down in front of the stand. A hinged flap 109 positioned above the support serves as a one-way gate which permits the cushions to be pulled from the bag, but prevents them from falling back in.

The invention has a number of important features and advantages. It provides the benefits of loose fill materials without the disadvantages and problems normally associated with them. The finished cushions do not require any more space for shipment and storage than the materials from which they are made, and they eliminate the need to make the cushions at or near the point of use. Being formed in strings with tear lines between them, the cushions can be torn apart easily and used individually or in groups, as desired.

It is apparent from the foregoing that a new and improved packing cushion and machine and method for making the same have been provided. While only certain presently preferred embodiments have been described in detail, as will be apparent to those familiar with the art, certain changes and modifications can be made without departing from the scope of the invention as defined by the following claims.

What is claimed is:

1. A cushioning material comprising a string of cushions formed by two superposed layers of flexible plastic film sealed together along transversely extending lines to form a series of vented chambers, a plurality of individual particles of loose fill packing material in each of the chambers, with the particles of loose fill packing material being free to move about within the chambers and conform to the shape of an object cushioned thereby, and perforations in the film between the chambers defining tear lines by which the cushions can be separated.

2. The cushioning material of claim 1 wherein the film is sealed together along two lines between adjacent ones of the cushions, and the tear lines are positioned between the two lines.

3. A cushioning material comprising a string of cushions formed by two superposed layers of flexible plastic film sealed together in discrete spaced apart areas along transversely extending lines to form a series of chambers, a plurality of individual particles of loose fill packing material in each of the chambers, with the particles of loose fill packing material being free to move about within the chambers to conform to the shape of an object cushioned thereby and air being able to pass into and out of the chambers through spaces between the sealed areas, and perforations in the film between the chambers defining tear lines by which the cushions can be separated.

4. A cushioning material for use in shipping cartons, comprising a string of cushions formed by an elongated length of flexible plastic tubing which is sealed together along a plurality of longitudinally spaced apart, transversely extending lines to form a series of vented chambers, a plurality of individual particles of loose fill packing material in each of the chambers, with the particles of loose fill packing material being free to move about within the chambers and conform to the shape of an object in a shipping carton, and perforations in the film between the chambers defining tear lines by which the cushions can be separated.

5. The cushioning material of claim 4 wherein the film is sealed together along two lines between adjacent ones of the cushions, and the tear lines are positioned between the two lines.

6. A cushioning material for use in shipping cartons, comprising a string of cushions formed by an elongated length of flexible plastic tubing which is sealed together in discrete spaced apart areas along a plurality of longitudinally spaced, transversely extending lines to form a series of chambers, a plurality of individual particles of loose fill packing material in each of the chambers with the particles of loose fill packing material being free to move about within the chambers to conform to the shape of an object in a shipping carton and air being able to pass into and out of the chambers through spaces between the sealed areas, and perforations in the film between the chambers defining tear lines by which the cushions can be separated.

* * * * *